US010141098B2

(12) United States Patent
Igarashi

(10) Patent No.: US 10,141,098 B2
(45) Date of Patent: Nov. 27, 2018

(54) COIL COMPONENT

(71) Applicant: Murata Manufacturing Co., Ltd., Kyoto (JP)

(72) Inventor: Akio Igarashi, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 15/014,605

(22) Filed: Feb. 3, 2016

(65) Prior Publication Data

US 2016/0240305 A1 Aug. 18, 2016

(30) Foreign Application Priority Data

Feb. 12, 2015 (JP) ..... 2015-025773
Aug. 26, 2015 (JP) ..... 2015-166408

(51) Int. Cl.

| | |
|---|---|
| ***H01F 27/29*** | (2006.01) |
| ***H01F 27/24*** | (2006.01) |
| ***H01F 17/04*** | (2006.01) |
| ***H01F 27/28*** | (2006.01) |
| *H01F 27/255* | (2006.01) |

(52) U.S. Cl.

CPC ..... *H01F 27/2823* (2013.01); *H01F 27/2828* (2013.01); *H01F 27/292* (2013.01); *H01F 27/255* (2013.01)

(58) Field of Classification Search

CPC ..... H01F 27/292; H01F 17/04; H01F 41/082
USPC ..... 336/192, 212, 221, 233
See application file for complete search history.

(56) References Cited

U.S. PATENT DOCUMENTS 4,527,141 A * 7/1985 Post ..... H01F 5/04 336/192
4,602,751 A * 7/1986 Vogel ..... B65H 75/148 242/118.4
4,904,974 A * 2/1990 Tsuji ..... H01H 50/44 335/296
6,480,085 B2 * 11/2002 Chiang ..... H01F 5/02 336/192

(Continued)

FOREIGN PATENT DOCUMENTS

| | | |
|---|---|---|
| CN | 203536151 U | 4/2014 |
| JP | 2014-099586 A | 5/2014 |
| JP | 2014-099588 A | 5/2014 |

OTHER PUBLICATIONS

An Office Action; "Notification of Reasons for Refusal," issued by the Japanese Patent Office dated Mar. 6, 2018, which corresponds to Japanese Patent Application No. 2015-166408 and is related to U.S. Appl. No. 15/014,605.

(Continued)

*Primary Examiner* — Alexander Talpalatski
*Assistant Examiner* — Joselito Baisa
(74) *Attorney, Agent, or Firm* — Studebaker & Brackett PC

(57) ABSTRACT

A coil component has a core having a winding core portion and first and second flange portions, a plurality of wires wound around the winding core portion, and a plurality of electrode portions disposed on the first and second flange portions. The first wire and the third wire cross each other on the first flange portion. The first flange portion has a groove at a position of crossing of the first wire and the third wire. The first wire on the lower side passes through the groove so that the first wire and the third wire are separated from each other.

4 Claims, 5 Drawing Sheets

(56) References Cited

U.S. PATENT DOCUMENTS 6,522,230 B2 * 2/2003 Hanato ..... H01F 17/045 336/192
6,778,055 B1 * 8/2004 Wang ..... H01F 27/292 336/208
7,212,093 B2 * 5/2007 Singu ..... H01F 17/045 336/83
7,256,673 B2 * 8/2007 Okumura ..... H01F 17/045 336/192
7,358,842 B1 * 4/2008 Liu ..... H01F 17/045 336/200
7,365,630 B1 * 4/2008 Yang ..... H01F 3/12 336/198
7,373,715 B2 * 5/2008 Hirai ..... H01F 17/045 264/250
7,688,173 B2 * 3/2010 Azuma ..... H01F 17/045 336/200
7,855,627 B2 * 12/2010 Nishikawa ..... H01F 17/045 336/200
7,893,805 B2 * 2/2011 Lu ..... H01F 5/04 336/198
8,643,460 B2 * 2/2014 Tseng ..... H01F 27/06 336/182
8,686,822 B2 * 4/2014 Huang ..... H01F 27/292 336/170
9,200,388 B1 * 12/2015 Gallmeyer ..... B65H 54/02
2002/0057160 A1 * 5/2002 Hanato ..... H01F 17/045 336/83
2003/0201868 A1 * 10/2003 McMichael ..... H01F 27/402 337/380
2012/0038448 A1 * 2/2012 Kim ..... H01F 27/325 336/192
2014/0292465 A1 * 10/2014 Takagi ..... H01F 27/292 336/192

OTHER PUBLICATIONS

Notification of the First Office Action issued by the State Intellectual Property Office of the People's Republic of China dated Jan. 2, 2018, which corresponds to Chinese Patent Application No. 201610059383.9 and is related to U.S. Appl. No. 15/014,605.

* cited by examiner

COIL COMPONENT

CROSS REFERENCE TO RELATED APPLICATIONS

This application claims benefit of priority to Japanese Patent Application 2015-025773 filed Feb. 12, 2015. and to Japanese Patent Application No. 2015-166408 filed Aug. 26, 2015, the entire content of which is incorporated herein by reference.

TECHNICAL FIELD

The present disclosure relates to a coil component.

BACKGROUND

Conventional coil components include a coil component described in Japanese Patent Publication No. 2014-99588. The coil component has a core having a winding core portion and a pair of flange portions disposed on both ends of the winding core portion, a plurality of wires wound around the winding core portion, and electrode portions disposed on the flange portions and connected to the plurality of wires.

SUMMARY

Problem to be Solved by the Disclosure

In the conventional coil component, the two wires cross each other such that the wires are in contact with each other via coating films on the flange portions. Therefore, an electric field generated by applying voltage to the wires concentrates on contact parts of the two wires and makes the field intensity of the contact parts higher. The insulation quality of the wire coating films may consequently be reduced at the contact parts.

Therefore, a problem of the present disclosure is to provide a coil component capable of improving insulation quality of a wire coating film.

Solutions to the Problems

To solve the problem, the present disclosure provides a coil component comprising:

a core having a winding core portion and first and second flange portions disposed on both ends of the winding core portion;

a plurality of wires wound around the winding core portion; and a plurality of electrode portions disposed on the first and second flange portions and connected to the plurality of wires, wherein the plurality of wires includes two wires crossing each other on the first flange portion, the first flange portion has a groove at a position of crossing of the two wires, and the lower one of the two wires passes through the groove so that the two wires are separated from each other.

According to the coil component of the present disclosure, the first flange portion has the groove at a position of crossing of the two wires and the lower one of the two wires passes through the groove so that the two wires are separated from each other. Therefore, although an electric field generated on the first flange portion between the two wires by application of voltage concentrates on the crossing part of the two wires, since the two wires are separated from each other at the crossing part, the field intensity is reduced and the insulation quality can be kept favorable in coating films.

Preferably, in the coil component of an embodiment, the plurality of wires includes two wires crossing each other on the second flange portion, the second flange portion has a groove at a position of crossing of the two wires, and the lower one of the two wires passes through the groove so that the two wires are separated from each other.

According to the coil component of the embodiment, the second flange portion has the groove at a position of crossing of the two wires and the lower one of the two wires passes through the groove so that the two wires are separated from each other. Therefore, although an electric field generated on the second flange portion between the two wires by application of voltage concentrates on the crossing part of the two wires, since the two wires are separated from each other at the crossing part, the field intensity is reduced and the insulation quality can be kept favorable in the coating films.

Preferably, in the coil component of an embodiment, the groove of the first flange portion and the groove of the second flange portion are positioned on the same plane parallel to an axis connecting both ends of the winding core portion, and the groove of the first flange portion and the groove of the second flange portion are located at rotationally symmetrical positions relative to a central axis that is orthogonal to the same plane and that passes through the center of the winding core portion.

According to the coil component of the embodiment, since the groove of the first flange portion and the groove of the second flange portion are located at the rotationally symmetrical positions relative to the central axis of the winding core portion, the symmetry of the shape of the coil component is ensured, leading to favorable coil characteristics of the coil component.

Preferably, in the coil component of an embodiment, the first flange portion has a protrusion at the position of crossing of the two wires, and the upper one of the two wires passes through the protrusion so that the two wires are separated from each other.

According to the coil component of the embodiment, the first flange portion has the protrusion at the position of crossing of the two wires and the upper one of the two wires passes through the protrusion so that the two wires are separated from each other. By disposing the protrusion in addition to the groove in this way, the distance between the two wires can be made larger. Therefore, the field intensity is further reduced at the crossing part and the insulation quality can be kept more favorable in the coating films.

A coil component of an embodiment comprises a core having a winding core portion and first and second flange portions disposed on both ends of the winding core portion;

a plurality of wires wound around the winding core portion; and a plurality of electrode portions disposed on the first and second flange portions and connected to the plurality of wires, the plurality of wires includes two wires crossing each other on the first flange portion, the first flange portion has a protrusion at a position of crossing of the two wires, and the upper one of the two wires passes through the protrusion so that the two wires are separated from each other.

According to the coil component of an embodiment, the first flange portion has the protrusion at a position of crossing of the two wires and the upper one of the two wires passes through the protrusion so that the two wires are separated from each other. Therefore, although an electric field generated on the first flange portion between the two wires by application of voltage concentrates on the crossing part of the two wires, since the two wires are separated from each other at the crossing part, the field intensity is reduced and the insulation quality can be kept favorable in coating films.

Effect of the Disclosure

According to the coil component of the present disclosure, because the first flange portion has the groove at a position of crossing of the two wires and the lower one of the two wires passes through the groove so that the two wires are separated from each other, although an electric field generated on the first flange portion between the two wires by application of voltage concentrates on the crossing part of the two wires, since the two wires are separated from each other at the crossing part, the field intensity is reduced and the insulation quality can be kept favorable in the coating films .

According to the coil component of the present disclosure, because the first flange portion has the protrusion at a position of crossing of the two wires and the upper one of the two wires passes through the protrusion so that the two wires are separated from each other, although an electric field generated on the first flange portion between the two wires by application of voltage concentrates on the crossing part of the two wires, since the two wires are separated from each other at the crossing part, the field intensity is reduced and the insulation quality can be kept favorable in the coating films.

DETAILED DESCRIPTION

The present disclosure will now be described in detail with reference to shown embodiments.

(First Embodiment)

Figure 1:
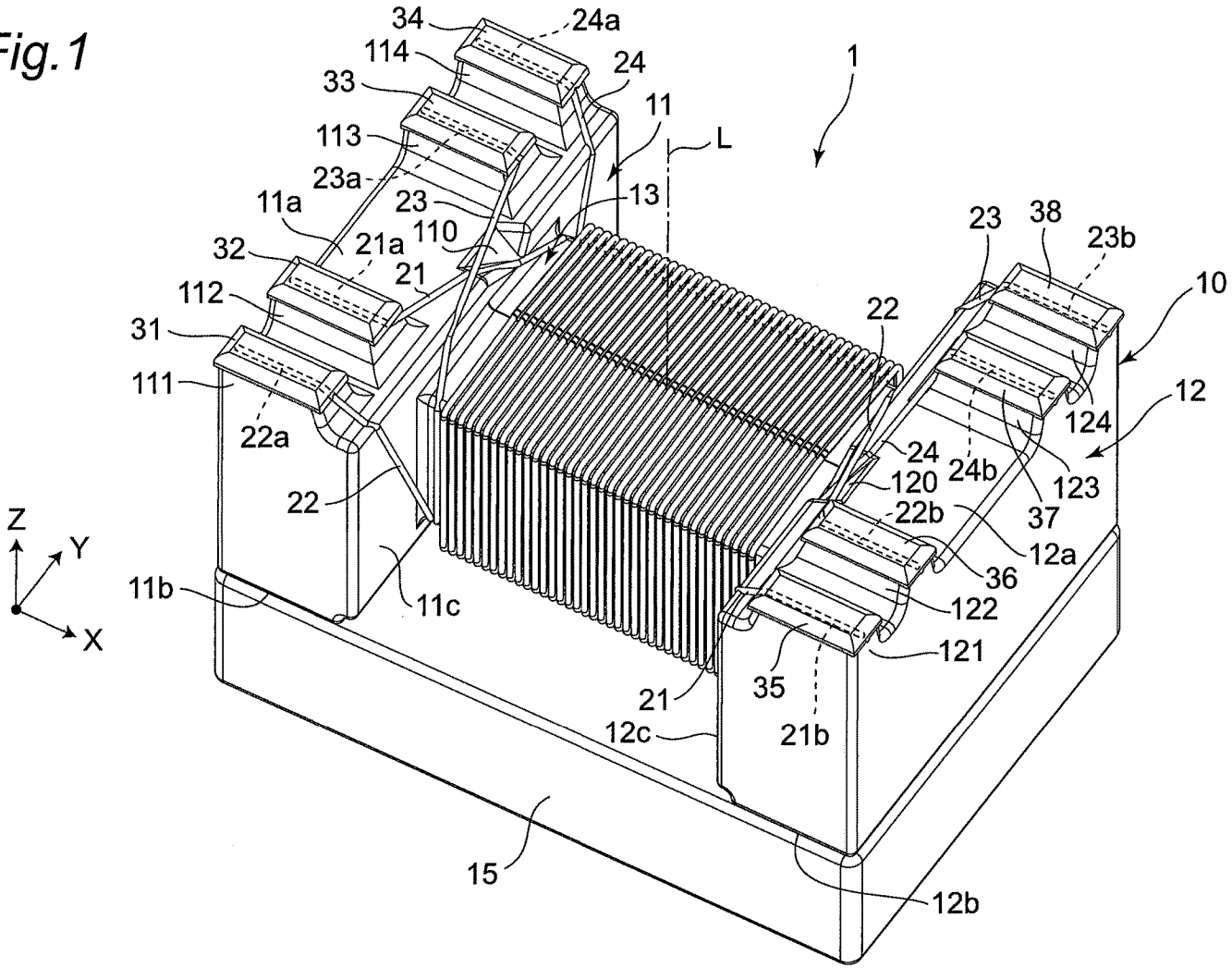
FIG. 1 is a perspective view of a coil component of a first embodiment of the present disclosure viewed from the bottom surface side.

FIG. 1 is a perspective view of a coil component of a first embodiment of the present disclosure viewed from the bottom surface side. As shown in FIG. 1, a coil component 1 is a surface-mount pulse transformer. The coil component 1 has a core 10, first to fourth wires 21 to 24 wound around the core 10, first to eighth electrode portions 31 to 38 disposed on the core 10, and a plate member 15 disposed on the core 10.

The core 10 has a winding core portion 13, a first flange portion 11 disposed at one end of the winding core portion 13, and a second flange portion 12 disposed at the other end of the winding core portion 13. The core 10 is made of a material such as alumina (non-magnetic material) , Ni—Zn-based ferrite (magnetic material, insulating material), and resin, for example.

A bottom surface of the core 10 is defined as a surface mounted on a substrate, and a top surface of the core 10 is defined as a surface on the side opposite to the bottom surface of the core 10. In FIG. 1, the bottom surface of the core 10 is positioned on the upper side and the top surface of the core 10 is positioned on the lower side. A direction connecting one end and the other end of the winding core portion 13 is defined as an X-direction, a direction orthogonal to the X-direction on the bottom surface of the core 10 is defined as a Y-direction, and a direction connecting the bottom surface and the top surface of the core 10 is defined as a Z-direction. The Z-direction is orthogonal to the X-direction and the Y-direction. The X-direction is defined as the length direction of the coil component 1, the Y-direction is defined as the width direction of the coil component 1, and the Z-direction is defined as the height direction of the coil component 1.

The winding core portion 13 extends from one end toward the other end thereof. The shape of the winding core portion 13 is a rectangular parallelepiped. The shape of the winding core portion 13 may be another shape such as a circular column.

An end surface 11*c* of the first flange portion 11 is connected to one end of the winding core portion 13. A bottom surface 11*a* of the first flange portion 11 is disposed with first to fourth leg portions 111 to 114. The first to fourth leg portions 111 to 114 are arranged in parallel in the Y-direction.

An end surface 12*c* of the second flange portion 12 is connected to the other end of the winding core portion 13. A bottom surface 12*a* of the second flange portion 12 is disposed with first to fourth leg portions 121 to 124. The first to fourth leg portions 121 to 124 of the second flange portion 12 respectively face the first to fourth leg portions 111 to 114 of the first flange portion 11 in the X-direction.

The first to fourth electrode portions 31 to 34 are respectively disposed on the first to fourth leg portions 111 to 114 of the first flange portion 11 . The fifth to eighth electrode portions 35 to 38 are respectively disposed on the first to fourth leg portions 121 to 124 of the second flange portion 12. The first to eighth electrode portions 31 to 38 are made of a material such as Ag, for example. The first to eighth electrode portions 31 to 38 are electrically connected to electrodes of a mounting substrate not shown and, as a result, the coil component 1 is mounted on the mounting substrate.

The plate member 15 is attached to a top surface 11*b* of the first flange portion 11 and a top surface 12*b* of the second flange portion 12. The plate member 15 is made of the same material as the core 10. The core 10 and the plate member 15 make up a closed magnetic circuit.

The first to fourth wires 21 to 24 are wound around the winding core portion 13. Each of first ends 21*a* to 24*a* of the first to fourth wires 21 to 24 is attached to the first flange portion 11. Specifically, the first end 21*a* of the first wire 21 is electrically connected to the second electrode portion 32 on the second leg portion 112. The first end 22*a* of the second wire 22 is electrically connected to the first electrode portion 31 on the first leg portion 111. The first end 23*a* of the third wire 23 is electrically connected to the third electrode portion 33 on the third leg portion 113. The first end 24*a* of the fourth wire 24 is electrically connected to the fourth electrode portion 34 on the fourth leg portion 114.

Similarly, each of second ends 21*b* to 24*b* of the first to fourth wires 21 to 24 is attached to the second flange portion 12. Specifically, the second end 21*b* of the first wire 21 is electrically connected to the fifth electrode portion 35 on the first leg portion 121. The second end 22*b* of the second wire 22 is electrically connected to the sixth electrode portion 36 on the second leg portion 122. The second end 23*b* of the third wire 23 is electrically connected to the eighth electrode portion 38 on the fourth leg portion 124. The second end 24*b* of the fourth wire 24 is electrically connected to the seventh electrode portion 37 on the third leg portion 123.

The first to fourth wires 21 to 24 have conductors and coating films covering the conductors. The first to fourth wires 21 to 24 are wound in a two-layer structure around the winding core portion 13. The first and fourth wires 21, 24 form a first layer in bifilar winding (i.e., two wires are alternately arranged in single layer winding) , and the second and third wires 22, 23 form a second layer in bifilar winding. The first to fourth wires 21 to 24 have the same number of turns.

The first electrode portion 31 and the second electrode portion 32 are connected via the electrodes of the mounting substrate to the same potential, and the first end 21*a* of the first wire 21 and the first end 22*a* of the second wire 22 are electrically connected. The first wire 21 and the second wire 22 make up a primary winding.

The seventh electrode portion 37 and the eighth electrode portion 38 are connected via the electrodes of the mounting substrate to the same potential, and the second end 23*b* of the third wire 23 and the second end 24*b* of the fourth wire 24 are electrically connected. The third wire 23 and the fourth wire 24 make up a secondary winding.

The fifth electrode portion 35 acts as a positive terminal of input and the sixth electrode portion 36 acts as a negative terminal of input. The third electrode portion 33 acts as a positive terminal of output and the fourth electrode portion 34 acts as a negative terminal of output.

Figure 2:
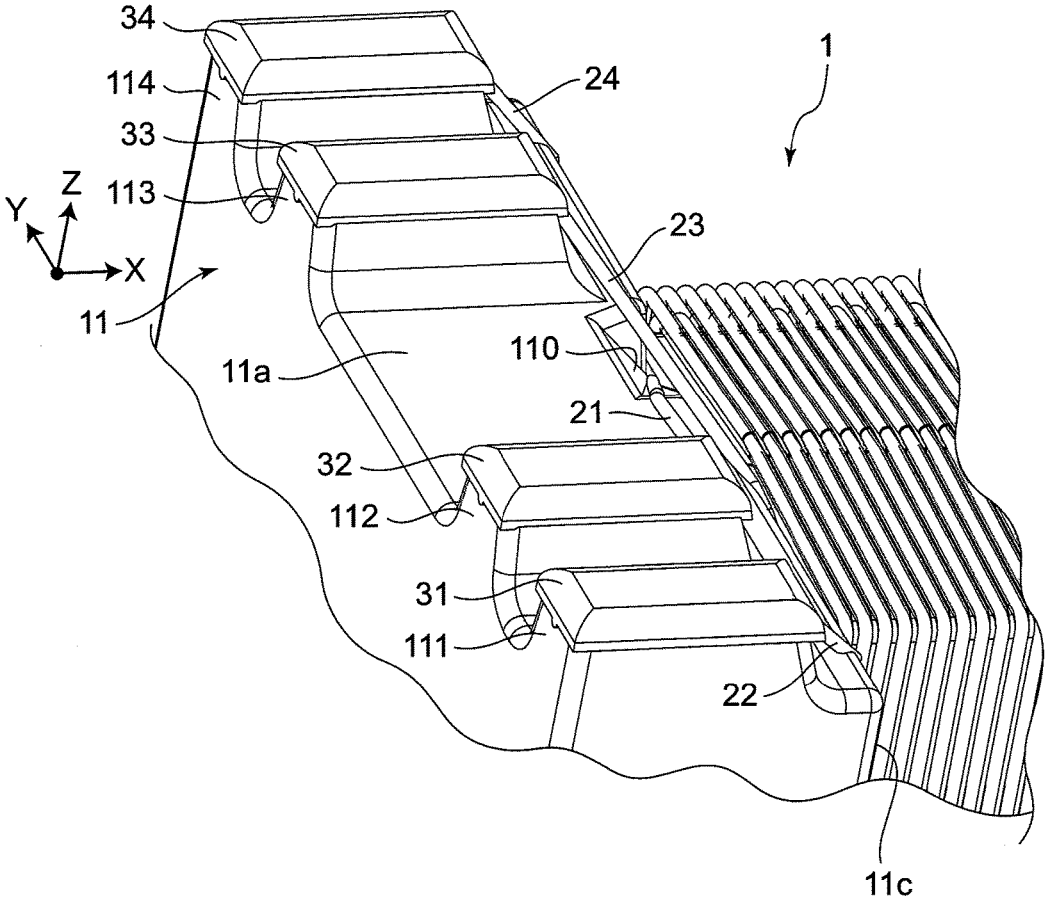
FIG. 2 is an enlarged perspective view of the first flange portion side of the coil component.

FIG. 2 is an enlarged perspective view of the first flange portion 11 side of the coil component 1. As shown in FIGS. 1 and 2, the first wire 21 and the third wire 23 cross each other on the first flange portion 11 such that the first wire 21 is positioned closer to the first flange portion 11 (on the lower side) relative to the third wire 23. The first flange portion 11 has a groove 110 at a position of crossing of the first wire 21 and the third wire 23. The first wire 21 on the lower side passes through the groove 110 so that the first wire 21 and the third wire 23 are separated from each other. The groove 110 has a concave shape and is disposed on an end edge of the bottom surface 11*a* of the first flange portion 11 closer to the winding core portion 13.

As a result, the first wire 21 and the third wire 23 are separated from each other without contact at the position of crossing of the first wire 21 and the third wire 23. Therefore, although an electric field generated between the first wire 21 and the third wire 23 by application of voltage concentrates on the crossing part of the first wire 21 and the third wire 23, since the first wire 21 and the third wire 23 are separated from each other at the crossing part, the field intensity is reduced and the insulation quality can be kept favorable in the coating films of the first wire 21 and the third wire 23. Since the groove 110 is disposed on the first flange portion 11, the first wire 21 and the third wire 23 can be wound around the winding core portion 13 to the maximum extent as compared to when a protrusion is disposed on the first flange portion 11.

Similarly, as shown in FIG. 1, the second wire 22 and the fourth wire 24 cross each other on the second flange portion 12 such that the fourth wire 24 is positioned closer to the second flange portion 12 (on the lower side) relative to the second wire 22. The second flange portion 12 has a groove 120 at a position of crossing of the second wire 22 and the fourth wire 24. The fourth wire 24 on the lower side passes through the groove 120 so that the second wire 22 and the fourth wire 24 are separated from each other. The groove 120 has the same shape as the groove 110 of the first flange portion 11.

As a result, the second wire 22 and the fourth wire 24 are separated from each other without contact at the position of crossing of the second wire 22 and the fourth wire 24. Therefore, although an electric field generated between the second wire 22 and the fourth wire 24 by application of voltage concentrates on the crossing part of the second wire 22 and fourth wire 24, since the second wire 22 and the fourth wire 24 are separated from each other at the crossing part, the field intensity is reduced and the insulation quality can be kept favorable in the coating films of the second wire 22 and the fourth wire 24.

The groove 110 of the first flange portion 11 and the groove 120 of the second flange portion 12 are positioned on the same plane parallel to an axis connecting both ends of the winding core portion 13. The groove 110 of the first flange portion 11 and the groove 120 of the second flange portion 12 are located at 180° rotationally symmetrical positions relative to a central axis L that is orthogonal to the same plane and that passes through the center of the winding core portion 13.

Since the groove 110 of the first flange portion 11 and the groove 120 of the second flange portion 12 are located at the rotationally symmetrical positions relative to the central axis L of the winding core portion 13, the symmetry of the shape of the coil component 1 is ensured, leading to favorable coil characteristics of the coil component 1 and facilitating handling during manufacturing.

(Second Embodiment)

Figure 3:
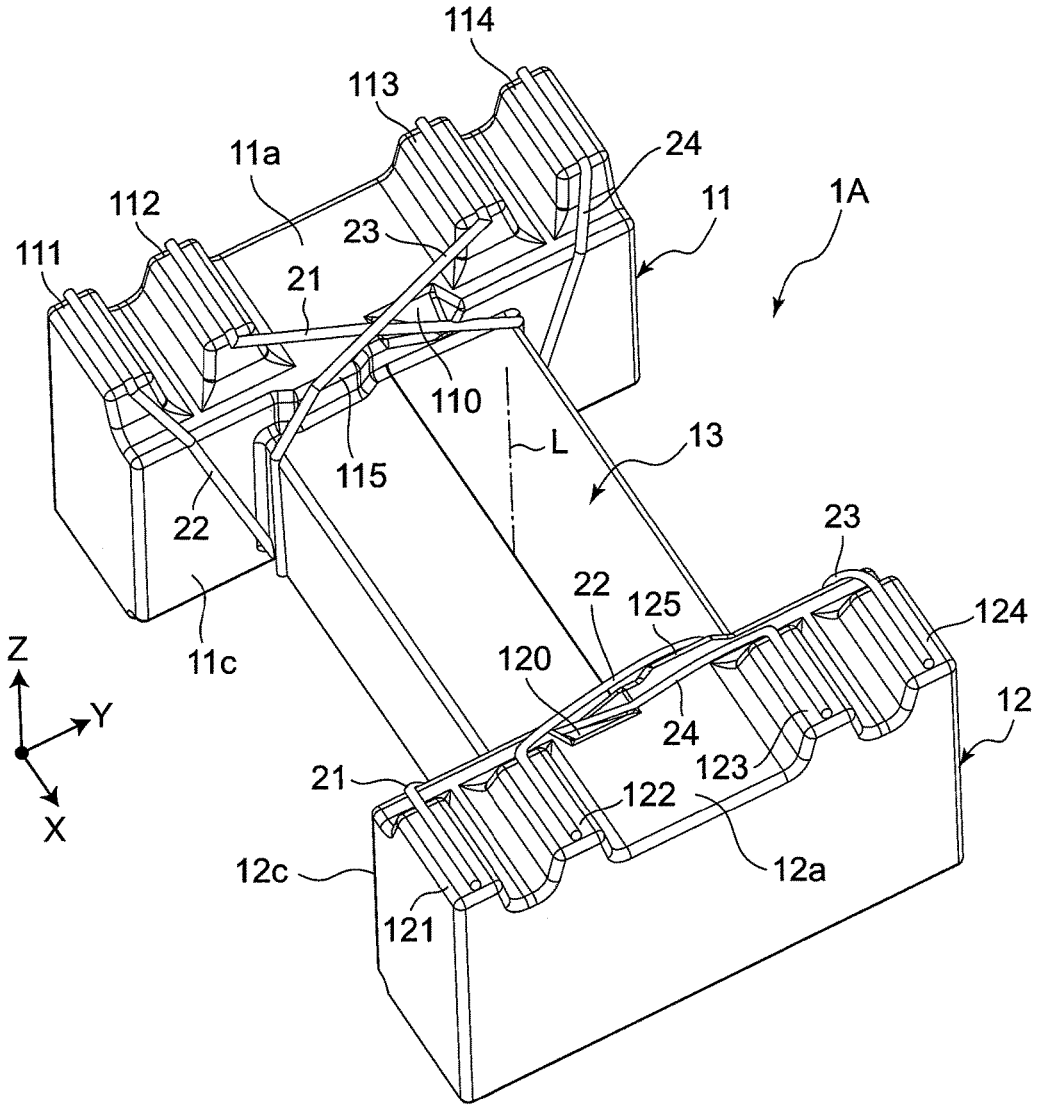
FIG. 3 is a perspective view of a coil component of a second embodiment of the present disclosure viewed from the bottom surface side.
Figure 4:
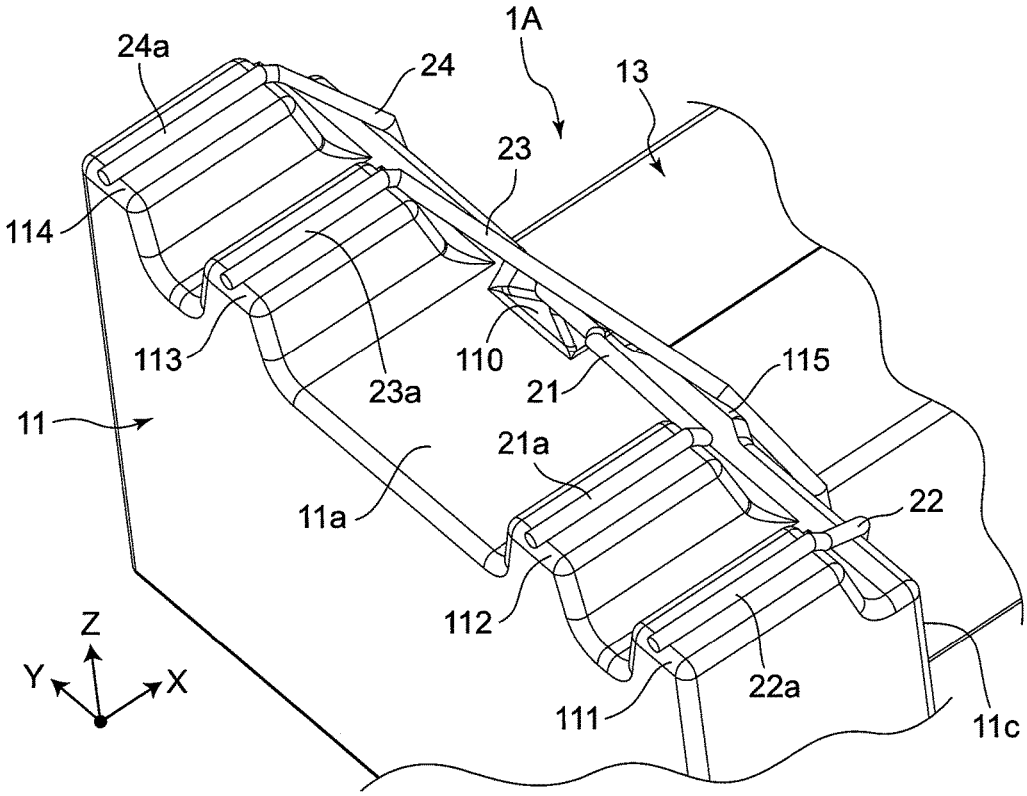
FIG. 4 is an enlarged perspective view of the first flange portion side of the coil component.

FIG. 3 is a perspective view of a coil component of a second embodiment of the present disclosure viewed from the bottom surface side. FIG. 4 is an enlarged perspective view of FIG. 3. In FIGS. 3 and 4, the first to eighth electrode portions 31 to 38 are not shown; portions of the first to fourth wires 21 to 24 wound around the winding core portion 13 are not shown; and the plate member 15 is not shown.

The second embodiment is different from the first embodiment only in the configuration of protrusion. Only this different configuration will hereinafter be described. In the second embodiment, the constituent elements denoted by the same reference numerals as the first embodiment are the same as those of the first embodiment and therefore will not be described.

As shown in FIGS. 3 and 4, in a coil component 1A of the second embodiment, the first flange portion 11 has a protrusion 115 at a position of crossing of the first wire 21 and the third wire 23. The third wire 23 on the upper side passes through the protrusion 115 so that the first wire 21 and the third wire 23 are separated from each other.

The protrusion 115 is disposed on an end edge of the bottom surface 11*a* of the first flange portion 11 closer to the winding core portion 13 and on the end surface 11*c* of the first flange portion 11 closer to the winding core portion 13. The protrusion 115 is adjacent to the groove 110 in the Y-direction. The protrusion 115 is positioned closer to the third wire 23 led out from the winding core portion 13 as compared to the groove 110.

By disposing the protrusion 115 on the first flange portion 11 in addition to the groove 110 in this way, the distance between the first wire 21 and the third wire 23 can be made larger at the position of crossing of the first wire 21 and the third wire 23. Therefore, the field intensity is further reduced at the crossing part of the first wire 21 and third wire 23 and the insulation quality can be kept more favorable in the coating films of the first wire 21 and the third wire 23.

Similarly, as shown in FIG. 3, the second flange portion 12 has a protrusion 125 at a position of crossing of the second wire 22 and the fourth wire 24. The second wire 22 on the upper side passes through the protrusion 125 so that the second wire 22 and the fourth wire 24 are separated from each other. The protrusion 125 has the same shape as the protrusion 115 of the first flange portion 11.

By disposing the protrusion 125 on the second flange portion 12 in addition to the groove 120 in this way, the distance between the second wire 22 and the fourth wire 24 can be made larger at the position of crossing of the second wire 22 and the fourth wire 24. Therefore, the field intensity is further reduced at the crossing part of the second wire 22 and the fourth wire 24 and the insulation quality can be kept more favorable in the coating films of the second wire 22 and the fourth wire 24.

The protrusion 115 of the first flange portion 11 and the protrusion 125 of the second flange portion 12 are positioned on the same plane parallel to an axis connecting both ends of the winding core portion 13. The protrusion 115 of the first flange portion 11 and the protrusion 125 of the second flange portion 12 are located at 180° rotationally symmetrical positions relative to the central axis L that is orthogonal to the same plane and that passes through the center of the winding core portion 13.

Since the protrusion 115 of the first flange portion 11 and the protrusion 125 of the second flange portion 12 are located at the rotationally symmetrical positions relative to the central axis L of the winding core portion 13, the symmetry of the shape of the coil component 1A is ensured, leading to favorable coil characteristics of the coil component 1A and facilitating handling during manufacturing.

(Third Embodiment)

Figure 5:
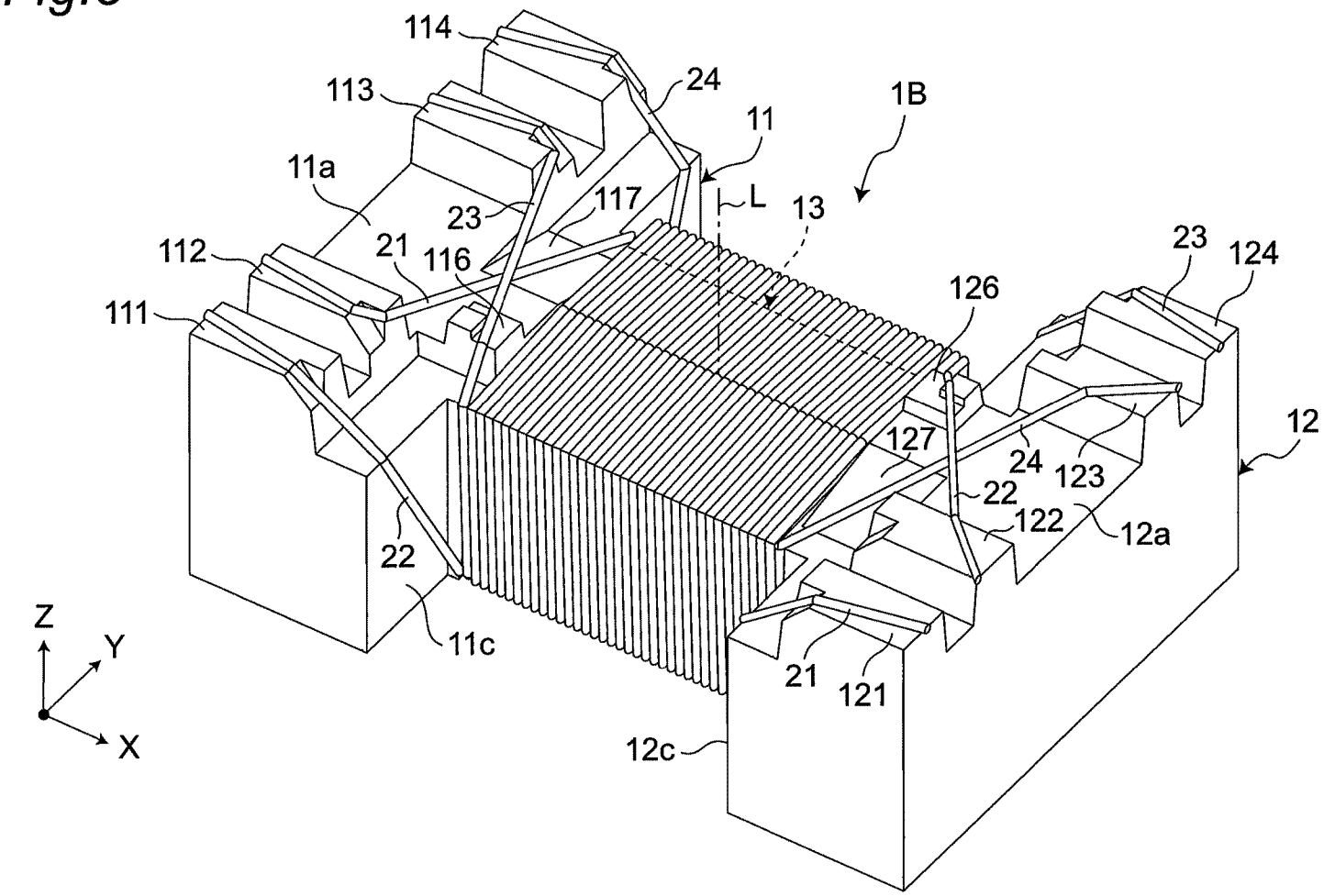
FIG. 5 is a perspective view of a coil component of a third embodiment of the present disclosure viewed from the bottom surface side.

FIG. 5 is a perspective view of a coil component of a third embodiment of the present disclosure viewed from the bottom surface side. In FIG. 5, the first to eighth electrode portions 31 to 38 of the first embodiment (FIG. 1) are not shown and the plate member 15 is not shown.

The third embodiment is different from the first embodiment in the configuration disposed with a protrusion without a groove. This different configuration will hereinafter be described. In the third embodiment, the constituent elements denoted by the same reference numerals as the first embodiment are the same as those of the first embodiment and therefore will not be described.

As shown in FIG. 5, in a coil component 1B of the third embodiment, the first flange portion 11 has a protrusion 116 at a position of crossing of the first wire 21 and the third wire 23. The third wire 23 on the upper side passes through the protrusion 116 so that the first wire 21 and the third wire 23 are separated from each other.

The protrusion 116 is disposed close to the winding core portion 13 on the bottom surface 11*a* of the first flange portion 11. The protrusion 116 protrudes in the Z-direction. A slope 117 is disposed adjacently to the protrusion 116 in the Y-direction. The first wire 21 on the lower side passes through the slope 117. The protrusion 116 is positioned closer to the third wire 23 led out from the winding core portion 13 as compared to the slope 117.

By disposing the protrusion 116 on the first flange portion 11 in this way, the distance between the first wire 21 and the third wire 23 can be made larger at the position of crossing of the first wire 21 and the third wire 23. Therefore, the field intensity is reduced at the crossing part of the first wire 21 and the third wire 23 and the insulation quality can be kept favorable in the coating films of the first wire 21 and the third wire 23.

Similarly, as shown in FIG. 5, the second flange portion 12 has a protrusion 126 at a position of crossing of the second wire 22 and the fourth wire 24. The second wire 22 on the upper side passes through the protrusion 126 so that the second wire 22 and the fourth wire 24 are separated from each other. The protrusion 126 has the same shape as the protrusion 116 of the first flange portion 11. A slope 127 is disposed adjacently to the protrusion 126 in the Y-direction. The fourth wire 24 on the lower side passes through the slope 127.

By disposing the protrusion 126 on the second flange portion 12 in this way, the distance between the second wire 22 and the fourth wire 24 can be made larger at the position of crossing of the second wire 22 and the fourth wire 24. Therefore, the field intensity is reduced at the crossing part of the second wire 22 and the fourth wire 24 and the insulation quality can be kept favorable in the coating films of the second wire 22 and the fourth wire 24.

The protrusion 116 of the first flange portion 11 and the protrusion 126 of the second flange portion 12 are positioned on the same plane parallel to an axis connecting the both ends of the winding core portion 13. The protrusion 116 of the first flange portion 11 and the protrusion 126 of the second flange portion 12 are located at 180° rotationally symmetrical positions relative to the central axis L that is orthogonal to the same plane and that passes through the center of the winding core portion 13.

Since the protrusion 116 of the first flange portion 11 and the protrusion 126 of the second flange portion 12 are located at the rotationally symmetrical positions relative to the central axis L of the winding core portion 13, the symmetry of the shape of the coil component 1B is ensured, leading to favorable coil characteristics of the coil component 1B and facilitating handling during manufacturing.

The present disclosure is not limited to the embodiments described above and can be changed in design without departing from the spirit of the present disclosure. For example, the respective characteristic points of the first to third embodiments may variously be combined.

Although the groove is used in the first embodiment, the protrusion of the second embodiment may be used instead of the groove. In this case, the protrusion may be disposed on at least one of the first and second flange portions. In particular, the protrusion is disposed at a position of crossing of two wires. The upper wire passes through the protrusion so that the two wires are separated from each other. As a result, the two wires are separated from each other without contact at the position of crossing of the two wires. Therefore, although an electric field generated between the two wires by application of voltage concentrates on the crossing part of the two wires, since the two wires are separated from each other at the crossing part, the field intensity is reduced and the insulation quality can be kept favorable in the coating films.

Although the groove is disposed on each of the first and second flange portions in the first embodiment, the groove may be disposed on the first flange portion or the second flange portion.

Although the groove is disposed on each of the first and second flange portions in the first embodiment, the groove may be disposed on the first flange portion while the protrusion of the second embodiment may be disposed on the second flange portion.

Although the groove has a concave shape in the first embodiment, the groove may have a cutout shape cut out to the end surface of the flange portion in the Y-direction.

Although the groove and the protrusion are disposed on each of the first and second flange portions in the second embodiment, the groove and the protrusion may be disposed on the first flange portion or the second flange portion.

Although the protrusion is disposed on each of the first and second flange portions in the third embodiment, the protrusion may be disposed on the first flange portion or the second flange portion.

Although four wires are used in the first to third embodiments, at least two wires maybe used. Although eight electrode portions are used, at least two electrode portions may be used.

Although the groove of the first flange portion and the groove of the second flange portion are disposed at rotationally symmetrical positions relative to the central axis of the winding core portion in the first embodiment, the grooves may be disposed at positions that are not rotationally symmetrical.

Although the protrusion of the first flange portion and the protrusion of the second flange portion are disposed at rotationally symmetrical positions relative to the central axis of the winding core portion in the second and third embodiments, the protrusions may be disposed at positions that are not rotationally symmetrical.

Although the plate member is used in the first to third embodiments, the plate member may not be used.

Although the coil component is a surface-mount pulse transformer in the first to third embodiments, the coil component may be any coil component having at least two wires wound around a core.

The invention claimed is:

1. A coil component comprising:

a core having a winding core portion and first and second flange portions disposed on opposite ends of the winding core portion in a length direction, each of the first and second flange portions having an end surface to which a respective one of the opposite ends of the winding core portion is connected;

a plurality of wires wound around the winding core portion; and a plurality of electrode portions disposed on bottom surfaces of the first and second flange portions and connected to the plurality of wires, wherein the plurality of wires includes two wires crossing each other at the first flange portion, the first flange portion has a groove adjacent to a position of crossing of the two wires, the lower one of the two wires passes through the groove and the upper one of the two wires does not pass through the groove so that the two wires are separated from each other, the first flange portion has a protrusion adjacent to the position of crossing of the two wires, and the upper one of the two wires passes through the protrusion so that the two wires are separated from each other, and the protrusion and the groove being disposed on an end edge of the bottom surface of the first flange portion and directly adjacent to each other, the end edge being adjacent to the end surface of the first flange portion, and the protrusion protruding from the end surface of the first flange portion.

2. The coil component according to claim 1, wherein the plurality of wires includes two wires crossing each other at the second flange portion, the second flange portion has a groove adjacent to a position of crossing of the two wires, and the lower one of the two wires passes through the groove so that the two wires are separated from each other.

3. The coil component according to claim 2, wherein the groove of the first flange portion and the groove of the second flange portion are positioned on the same plane parallel to an axis connecting the opposite ends of the winding core portion in the length direction, and the groove of the first flange portion and the groove of the second flange portion are located at rotationally symmetrical positions relative to a central axis that is orthogonal to the same plane and that passes through the center of the winding core portion.

4. A coil component comprising:

a core having a winding core portion and first and second flange portions disposed on opposite ends of the winding core portion in a length direction, the first flange portion having a first end surface to which one of the opposite ends of the winding core portion is connected and a second end surface opposite to the first end surface;

a plurality of wires wound around the winding core portion; and a plurality of electrode portions disposed on bottom surfaces of the first and second flange portions and connected to the plurality of wires, the plurality of wires includes two wires crossing each other at the first flange portion, the first flange portion has a protrusion adjacent to a position of crossing of the two wires, the upper one of the two wires contacts the protrusion so that the two wires are separated from each other, the protrusion being disposed on the bottom surface of the first flange portion and closer to the first end surface than the second end surface, and the protrusion protruding from the bottom surface in a direction perpendicular to the bottom surface.

* * * * *